US007762782B2

(12) United States Patent
Wang

(10) Patent No.: US 7,762,782 B2
(45) Date of Patent: Jul. 27, 2010

(54) QUICK ASSEMBLY BLADE FOR A CEILING FAN (2)

(75) Inventor: Cliff Wang, Tanzih Township, Taichung County (TW)

(73) Assignee: Air Cool Industrial Co., Ltd., Taichung County (TW)

( * ) Notice: Subject to any disclaimer, the term of this patent is extended or adjusted under 35 U.S.C. 154(b) by 617 days.

(21) Appl. No.: 11/830,128

(22) Filed: Jul. 30, 2007

(65) Prior Publication Data

US 2009/0035140 A1 Feb. 5, 2009

(51) Int. Cl.
*F04D 29/34* (2006.01)

(52) U.S. Cl. ..... 416/210 R; 416/214 R

(58) Field of Classification Search ..... 416/210 R, 416/214 R; 403/315, 363, 329
See application file for complete search history.

(56) References Cited

U.S. PATENT DOCUMENTS 6,652,236 B2 * 11/2003 Hai ..... 416/206
6,821,091 B2 * 11/2004 Lee ..... 416/210 R
6,902,375 B2 * 6/2005 Bird et al. ..... 416/207
7,223,078 B1 * 5/2007 Mares et al. ..... 416/210 R

* cited by examiner

*Primary Examiner*—Ninh H Nguyen
(74) *Attorney, Agent, or Firm*—Ming Chow; Sinorica, LLC

(57) ABSTRACT

A quick assembly blade for a ceiling fan includes a blade frame, a blade and a press board. The blade frame has at least three studs respectively secured thereon with a fastener to be fitted in the insert holes of the blade and the engage holes of the press board. The engage holes of the press board have their rear ends respectively expanded to form a receiving hole with a comparatively large diameter. The blade is bored with a positioning hole among its insert holes, and the press board is disposed with at least one stopper at a location corresponding to the positioning hole of the blade. Thus, when the press board is assembled on the blade, the engage holes is respectively fixed with the underside of the fasteners, and the stopper is stuck in the positioning hole to prevent the press board from disengaging.

9 Claims, 6 Drawing Sheets

QUICK ASSEMBLY BLADE FOR A CEILING FAN (2)

BACKGROUND OF THE INVENTION

1. Field of the Invention

This invention relates to a ceiling fan, particularly to one whose blades are stable in structure, have integral beauty and can be assembled quickly.

2. Description of the Prior Art

For quickly assembling a blade of a conventional ceiling fan on a blade frame, the blade frame has its disc body secured with three studs, and the blade is bored with three engage holes respectively corresponding to the three studs of the blade frame. An elastic stopper is to be fitted on the studs at the front end of the blade frame, having its rear end protruding upward and formed with a stop member. In assembling, firstly, the blade has its engage holes respectively engaged with an engage portion at the upper end of the studs of the blade frame, and then each elastic stop strip is fitted on each stud with its stop member stopping the front end of the blade. Thus, after assembled on the blade frame, the blade cannot be shifted horizontally any longer, able to quickly assemble the blade and prevent it from being disengaged from the blade frame.

Although the blade of the conventional ceiling fan can be quickly assembled on the blade frame by mutual engagement of the engage holes of the blade and the studs of the blade frame, the structure of their engagement is unstable and the blade cannot be secured on the blade frame with stability. Under the circumstances, when the ceiling fan is driven to rotate, the blades are likely to be loosened and cause swing to disable the ceiling fan to rotate smoothly and stably. In addition, after the blade and the blade frame are assembled together, the elastic stop strip is positioned at the outside of the front end of the blade visibly exposed out, thus spoiling integral beauty of the blade of the ceiling fan.

SUMMARY OF THE INVENTION

The objective of this invention is to offer a quick assembly blade for a ceiling fan, including a blade frame, a blade and a press board. The blade frame is fixed thereon with at least three studs extending upward, spaced apart and respectively locked thereon with a fastener to be inserted in both the insert hole of the blade and the engage hole of the press board, with the head of the fastener inserted out of the upper side of the insert hole of the blade and the lower portion of the fastener engaged with the engage hole of the press board. Further, the blade is bored with a positioning hole at a location among the insert holes, and each engage hole of the press board has its rear end expanded and formed with a receiving hole with a comparatively large diameter. The press board is further disposed with an elastic stopper protruding downward at a location corresponding to the positioning hole of the blade, and having a stop member provided at the front end. By so designing, when the press board is pushed to move backward horizontally and fixedly pressed on the blade with a large area, the blade can be quickly assembled on the blade frame, able to reinforce the combined stability of the press board with the blade and the blade frame. In addition, after assembling of the blade, the elastic stopper of the press board is stuck on the inner wall of the positioning hole of the blade and hidden therein, able to keep integrity and external beauty of the ceiling fan.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
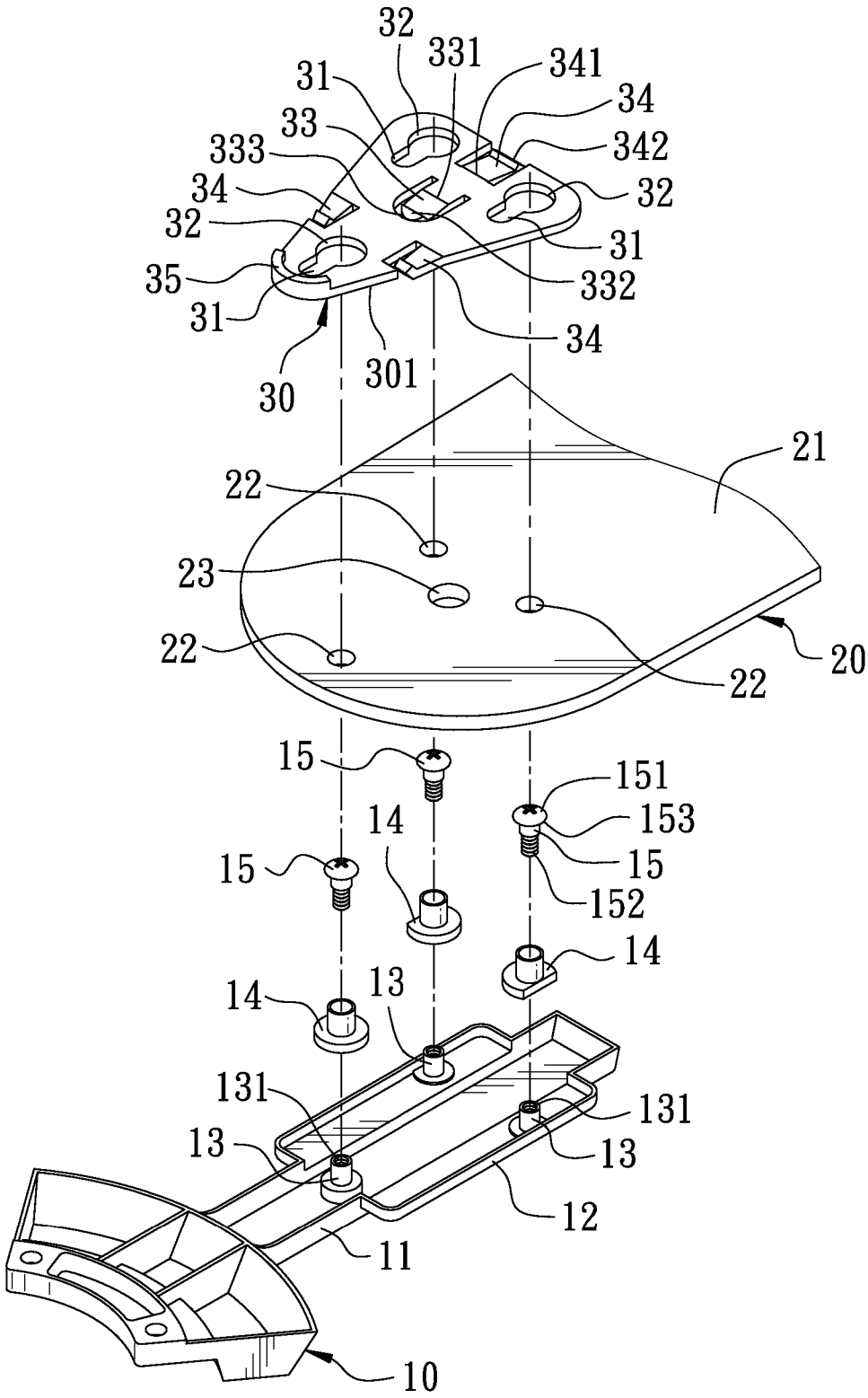
FIG. 1 is an exploded perspective view of a first preferred embodiment of a quick assembly blade for a ceiling fan in the present invention.
Figure 2:
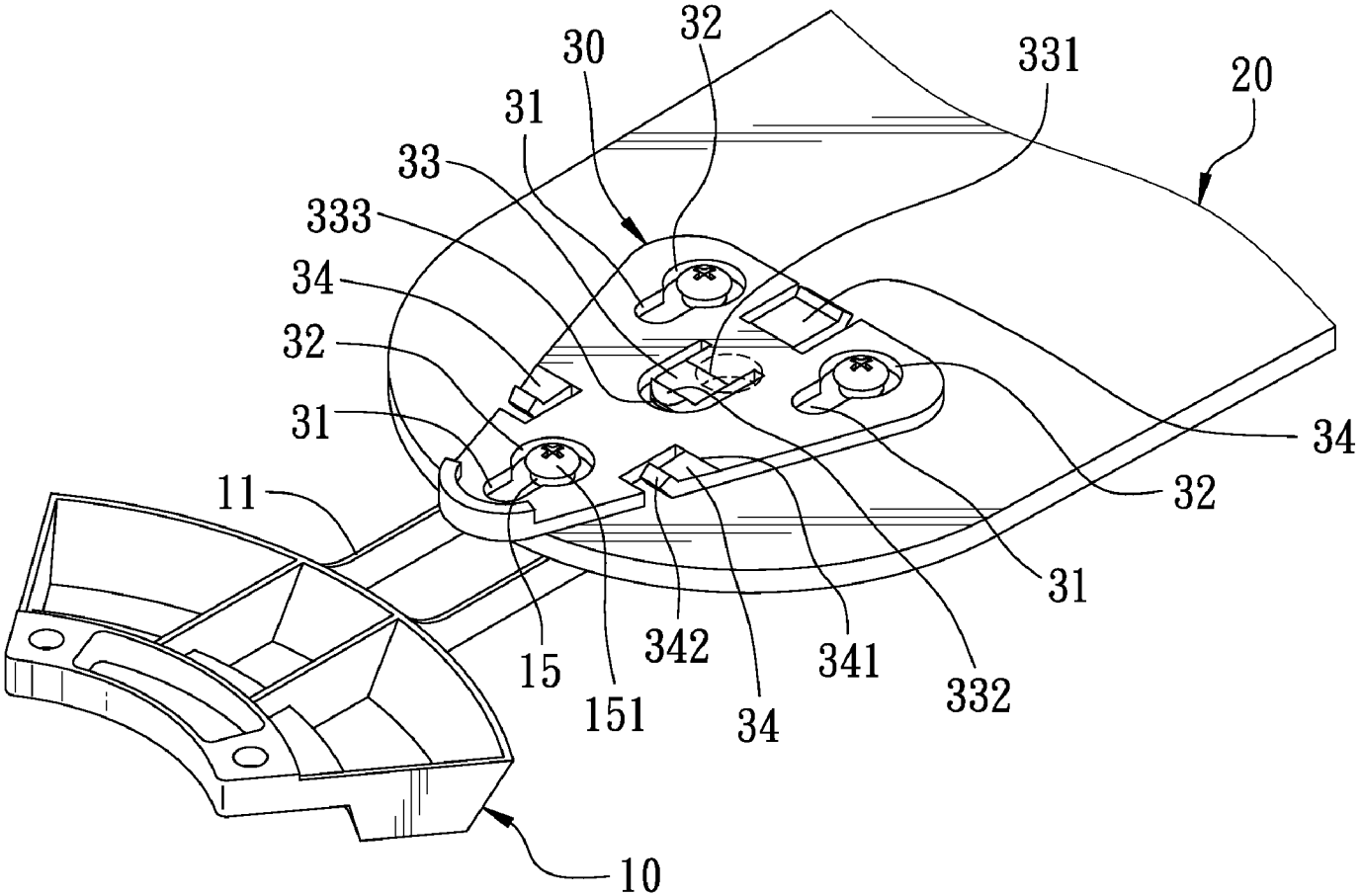
FIG. 2 is a perspective view of the first preferred embodiment of the quick assembly blade to be assembled on a blade frame in the present invention.
Figure 3:
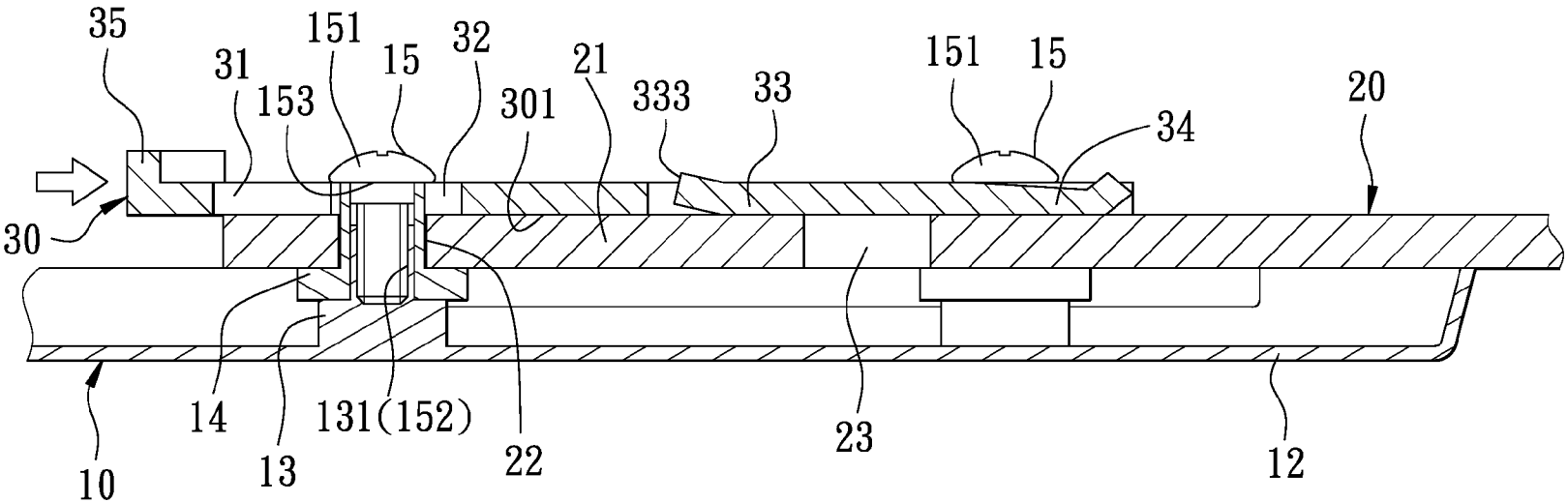
FIG. 3 is a side cross-sectional view of the first preferred embodiment of the quick assembly blade to be assembled on the blade frame in the present invention.

A first preferred embodiment of a quick assembly blade for a ceiling fan in the present invention, as shown in FIGS. 1, 2 and 3, includes a blade frame 10, a blade 20 and a press board 30 combined together.

The blade frame 10 has its rear end extended backward and formed with a framework 11 having its rear side expanded to form a pan-shaped body 12 formed integral with three studs 13 extending upward. One of the three studs 13 is positioned at the front end of the pan-shaped body 12, while the other two studs 13 are respectively positioned at the opposite rear ends of the pan-shaped body 12. The three studs 13 are spaced apart and arranged into a triangle in position, and respectively bored with a threaded hole 131 in the center. Further, the three studs 13 are respectively fitted thereon with a bushing 14 shaped as a hollow cylinder made of plastic and respectively secured thereon with a fastener 15 (a bolt), which has its upper end formed with comparatively large round head 151 and its lower end formed with threads 152 screwed in the threaded hole 131 of the stud 13 in advance.

The blade 20 shaped as a long plate has its front end formed with a combining portion 21 to be assembled on the pan-shaped body 11 of the blade frame 10. The combining portion 21 of the blade 20 is vertically bored with three insert holes 22 to be respectively fitted on the bushings 14 of the studs 13, with the bushings 14 respectively functioning to fill up an assembly gap of the insert hole 22 for reinforcing mutual engagement of the insert hole 22 and the stud 13. The combining portion 21 of the blade 20 is further bored with a positioning hole 23 at a location among the three insert holes 22.

The press board 30 is a triangular board made integrally of plastic to be pressed and fixed on the combining portion 21 of the blade 20. The press board 30 is bored with three engage holes 31 at the locations respectively corresponding to the three insert holes 22 of the combining portion 21, and each engage hole 31 has its rear end expanded and formed with a receiving hole 32 with a comparatively large diameter. The engage holes 31 of the press board 30 are respectively to be engaged and secured with the underside 153 of the head 151 of the fastener 15 for tightly clamping the blade 20 between the press board 30 and the blade frame 10. In addition, the press board 30 is disposed with an elastic stop strip 33 among the three engage holes 31 at a location corresponding to the positioning hole 23 of the blade 20. The elastic stopper 33 has its rear end formed with a connecting edge 331 connected with the press board 30 and its front end formed with a free edge 332 separated from the press board 30. Further, the stop strip 33 is extended downward obliquely from its connecting edge 331, and then bent upward to connect with its free edge 332, somewhat protruding out of the underside 301 of the press board 30 and having the front end of its free edge 332 formed with a stop member 333. Furthermore, the press board 30 has its three edges respectively fixed thereon with an elastic press member 34 arranged staggering with the engage holes 31. Each elastic press member 34 has a connecting edge 341 connected with the press board 30 and a free edge 342 separated from the press board 30, and each elastic press member 34 is extended downward obliquely from the connecting edge 341, and then bent upward to connect with the free edge 342, protruding a little out of the underside 301 of the press board 30. In addition, the press board 30 has the annular edge of its front end formed with a push member 35 extending upward for facilitating pushing of the press board 30. The press board 30 can be compression formed of metallic material.

Figure 4:
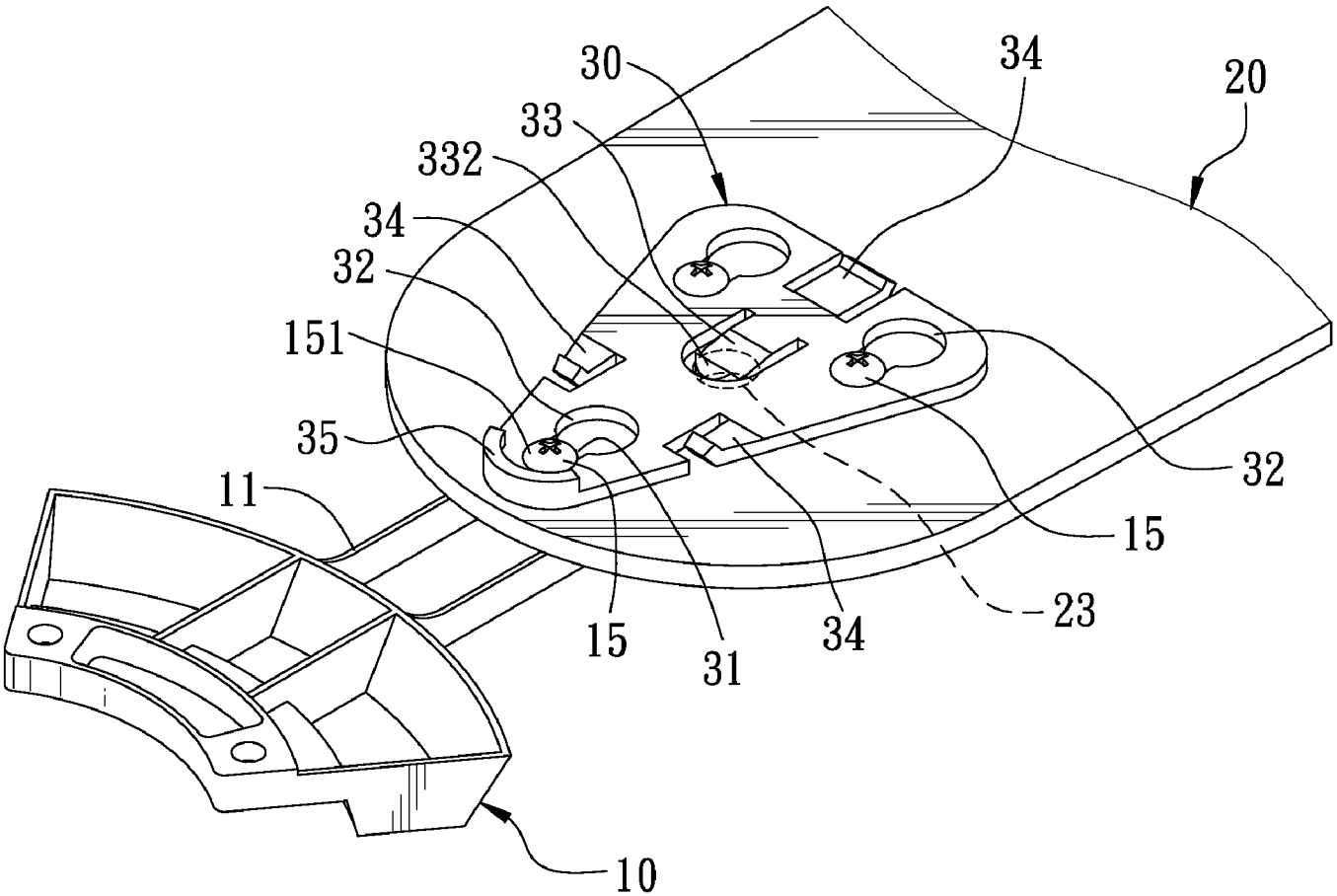
FIG. 4 is a perspective view of the first preferred embodiment of the quick assembly blade assembled on the blade frame in the present invention.
Figure 5:
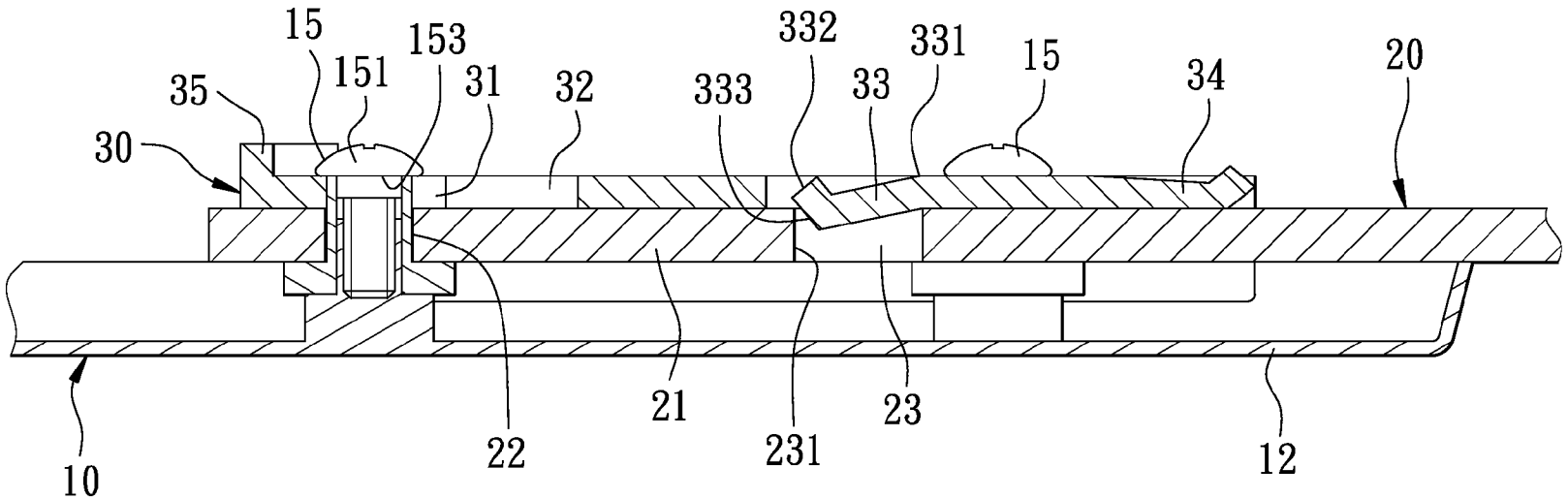
FIG. 5 is a side cross-sectional view of the first preferred embodiment of the quick assembly blade assembled on the blade frame in the present invention.

In assembling, as shown in FIG. 3, firstly, the bushings 14 are respectively fitted on the studs 13 with the fasteners 15 respectively locked on the studs 13 of the blade frame 10. Next, the insert holes 22 of the blade 20 are respectively and correspondingly fitted with the studs 13 of the blade frame 10 and then apply force to have the underside 301 of the press board 30 pressed flatly on the combining portion 21 of the blade 20. At this time, the heads 151 of the fasteners 15 are respectively positioned in the receiving holes 32 of the press board 30, and the stopper 33 and the elastic press members 34 are pressed to flatly position on the combining portion 21 of the blade 20. Subsequently, the push member 35 of the press board 30 is pushed to force the press board 30 to move horizontally toward the rear end of the blade 20. When the press board 30 together with its engage holes 31 and its stopper 33 is moved backward for a distance, the engage holes 31 will be respectively engaged with the undersides 153 of the fastener head 151 and secured on the fastener 15, letting the blade 20 clamped and pressed between the press board 30 and the blade frame 10, and meanwhile the stopper 33 is moved to the location of the positioning hole 23 of the blade 20, as shown in FIGS. 4 and 5. Thus, after released from the pressing force, the stopper 33 will recover to its original state by its own restored elasticity to have its stop member 333 engaged in the positioning hole 23 of the blade 20 and stuck on the inner wall 231 at the front end of the positioning hole 23 so as to stop the press board 30 from disengaged from the blade 20, thus quickly finishing assembly of the blade. After the blade 20 is assembled on the blade frame 10, the stopper 33 and its stop member 333 are hidden in the positioning hole 23 and positioned in the center of the press board 30 not exposed out, able to elevate integrity and external beauty of the ceiling fan. Additionally, the elastic press member 34 of the press board 30 with great elasticity are able to produce reverse elastic force to press against the blade 20 for enhancing combined stability of the press board 30 with the blade 20 and the blade frame 10.

Figure 6:
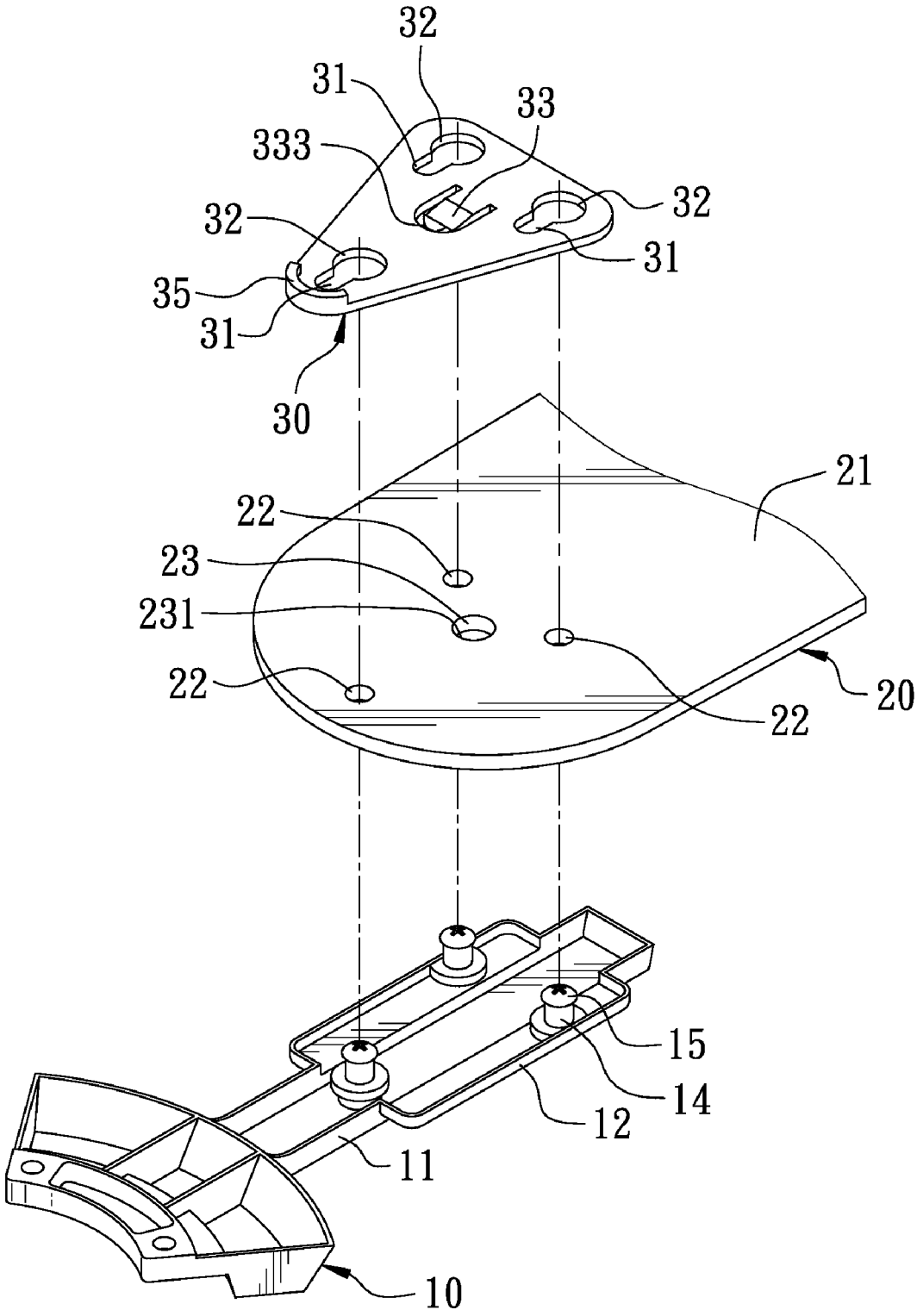
FIG. 6 is an exploded perspective view of a second preferred embodiment of a quick assembly blade for a ceiling fan in the present invention.

A second preferred embodiment of a quick assembly blade for a ceiling fan in the present invention, as shown in FIG. 6, includes a blade frame 10, a blade 20 and a press board 30. The blade frame 10 and the blade 20 of the second preferred embodiment respectively have the same structure as that described in the first preferred embodiment. The press board 30 to be fixed on the combining portion 21 of the blade 20 is bored with three engage holes 31 at the locations respectively corresponding to the three insert holes 22 of the blade 20. Each engage hole 31 of the press board 30 has its rear end expanded to form a receiving hole 32 with a comparatively large diameter, and the press board 30 is provided with an elastic stopper 33 protruding downward at a location matching with the positioning hole 23 of the blade 20. The stopper 33 has the edge of its front end formed with a stop member 333 to be stuck on the inner wall 231 of the positioning hole 23 of the blade 20 for performing action of stopping, thus equally enable the blade 20 to be quickly assembled on the blade frame 10 and prevent the press board 30 from disengaged from the blade 20. In addition, the press board 30 has the annular edge of its front end formed with a push member 35 protruding upward for facilitating pushing of the press board 30.

As can be understood from the above description, this invention has the following advantages.

1. The blade can be quickly and firmly assembled on the blade frame only by pushing the press board to move backward for a short distance and by having the stop member of the stopper of the press board stuck on the inner wall of the positioning hole of the blade to prevent the press board from disengaged from the blade.

2. The stopper and the stop member are formed at a central portion of the press board and hidden in the positioning hole of the blade not exposed out after the blade is assembled, affectively elevating the integral beauty of the ceiling fan.

3. The elastic press members of the press board are able to produce reverse elastic force for pressing against the blade, able to enhance assembled stability of the press board with the blade and the blade frame.

While the preferred embodiments of the invention have been described above, it will be recognized and understood that various modifications may be made therein and the appended claims are intended to cover all such modifications that may fall within the spirit and scope of the invention.

I claim:

1. A quick assembly blade for a ceiling fan comprising:

A blade frame having its rear end extended and formed with a framework, said framework having its rear side provided with a pan-shaped body, said pan-shaped body fixed thereon with three studs extending upward and spaced apart, each said stud secured thereon with a fastener, said fastener having its upper end formed with a head;

a blade having its front end formed with a combining portion to be assembled on said pan-shaped body of said blade frame, said combining portion of said blade bored with three insert holes to be respectively fitted on said three studs of said blade frame, said head of said fastener inserted through said insert hole of said blade and positioned over said insert hole, said blade further bored with a positioning hole at a location among said three insert holes of said combining portion; and a press board fixed on said combining portion of said blade, said press board bored with three engage holes at locations corresponding to said three insert holes of said blade, each said engage hole of said press board engaged and fixed with an underside of said head of said fastener, each said engage hole having its rear end expanded and formed with a receiving hole with a comparatively large diameter, said press board provided with an elastic stopper protruding downward at a location corresponding to said positioning hole of said blade, said elastic stopper having its front edge formed with a stop member to be stuck on an inner wall of said positioning hole of said blade.

2. The quick assembly blade for a ceiling fan as claimed in claim 1, wherein said elastic stopper is positioned at a central portion of said press board, having its rear end provided with a connecting edge connected with said press board and its front end formed with a free edge separated from said press board, said elastic stopper extending downward obliquely from said connecting edge and then bent upward to connect with said free edge, said elastic stopper extending to the underside of said press board, said free edge of said elastic stopper having its front end formed with a stop member.

3. The quick assembly blade for a ceiling fan as claimed in claim 1, wherein said press board is triangular, having its three edges respectively secured with an elastic press member positioned staggering with said three engage holes, each said elastic press member formed with a connecting edge connected with said press board and a free edge separated from said press board, each said elastic press member extending downward obliquely from said connecting edge and then bent upward to connect with said free edge, each said elastic press member extending to an underside of said press board, said elastic press member producing reverse elastic force to press against said blade for reinforcing combined stability of said press board with said blade and said blade frame.

4. The quick assembly blade for a ceiling fan as claimed in claim 1, wherein said three studs are integrally formed on said pan-shaped body of said blade frame, arranged into a triangle in position and respectively bored with a threaded hole in a center, said three studs respectively fitted thereon with a bushing, said fastener being a bolt having its upper end formed with a head with a comparatively large diameter, said fastener having its lower end formed with threads to be screwed in said threaded hole of said stud of said blade frame.

5. The quick assembly blade for a ceiling fan as claimed in claim 4, wherein said bushing is a hollow cylinder made of plastic.

6. The quick assembly blade for a ceiling fan as claimed in claim 1, wherein said press board is formed with a push member protruding upward along an annular edge of its front end.

7. The quick assembly blade for a ceiling fan as claimed in claim 3, wherein said press board has an annular edge of its front end formed with a push member protruding upward.

8. The quick assembly blade for a ceiling fan as claimed in claim 1, wherein said press board is compression made of metallic material.

9. The quick assembly blade for a ceiling fan as claimed in claim 1, wherein said press board is integrally made of plastic.

* * * * *